United States Patent [19]

Faneuf

[11] 4,277,863

[45] Jul. 14, 1981

[54] IDENTIFICATION CARD HOLDER

[76] Inventor: Daniel Faneuf, c/o Precision Design Co., 66 Nashua St., Milford, N.H. 03055

[21] Appl. No.: 38,338

[22] Filed: May 11, 1979

[51] Int. Cl.[3] ..... A44B 21/00; A45F 5/02

[52] U.S. Cl. ..... 24/3 R; 24/3 K; 24/248 R; 24/255 SL; 224/247

[58] Field of Search ..... 24/3 R, 3 H, 3 J, 3 L, 24/3 K, 11 R, 73 A, 73 CP, 81 CC, 255 SL, 248 R, 3 M; 224/247

[56] References Cited

U.S. PATENT DOCUMENTS

| | | | |
|---|---|---|---|
| 342,971 | 6/1886 | Ongley | 24/3 K |
| 926,401 | 6/1909 | Freedman | 24/3 J |
| 1,212,511 | 1/1917 | Kropp | 24/3 K |
| 2,775,804 | 1/1957 | Ayoub | 24/3 K |
| 3,357,615 | 12/1967 | Hill | 24/3 K |
| 3,515,363 | 6/1970 | Fisher | 24/255 SL |
| 3,604,071 | 9/1971 | Reimels | 24/248 R |
| 3,629,912 | 12/1971 | Klopp | 24/255 SL |
| 3,942,228 | 3/1976 | Buckman et al. | 24/255 SL |
| 3,983,602 | 10/1976 | Barry | 24/11 R |

*Primary Examiner*—Victor N. Sakran
*Attorney, Agent, or Firm*—James H. Grover

[57] ABSTRACT

A clip for engaging through an aperture in an ID card is molded of one unitary body of plastic comprises two elongate stiff parallel members joined at their middle by a flexible web forming a hinge. On one side of the hinge the members form opposed jaws and at the other side of the hinge one member forms a spring biased toward the other member to urge the jaws closed. The spring forms a loop capable of engaging through an aperture in an ID card. The loop is offset from the hinged members to allow the card to hang parallel alongside the hinged members.

5 Claims, 3 Drawing Figures

IDENTIFICATION CARD HOLDER

BACKGROUND OF THE INVENTION

The object of the invention is to provide an improved clip for holding an identification card or like sheet and attaching the card to a hem of clothing, for example the lapel or pocket, so that whether the hem is directed upwardly, as with a pocket, or downwardly, as with a collar, the ID card hangs from the clip parallel to the clip and clothing.

STATEMENT OF INVENTION

According to the invention a spring clip comprises two elongate, relatively stiff members; a relatively flexible web forming a hinge joining the two members intermediate their ends; opposed jaw portions on respective members at one side of the hinge; and a spring finger on one member at the other side of the hinge resiliently biased against the other member so as yieldingly to hold the jaws closed. Further according to the invention the spring forms a loop for engaging through an aperture of an identification card or similar sheet, the loop being offset from the hinged members so that the sheet may hang parallel to the clip members.

DRAWING

DESCRIPTION

Figure 1:
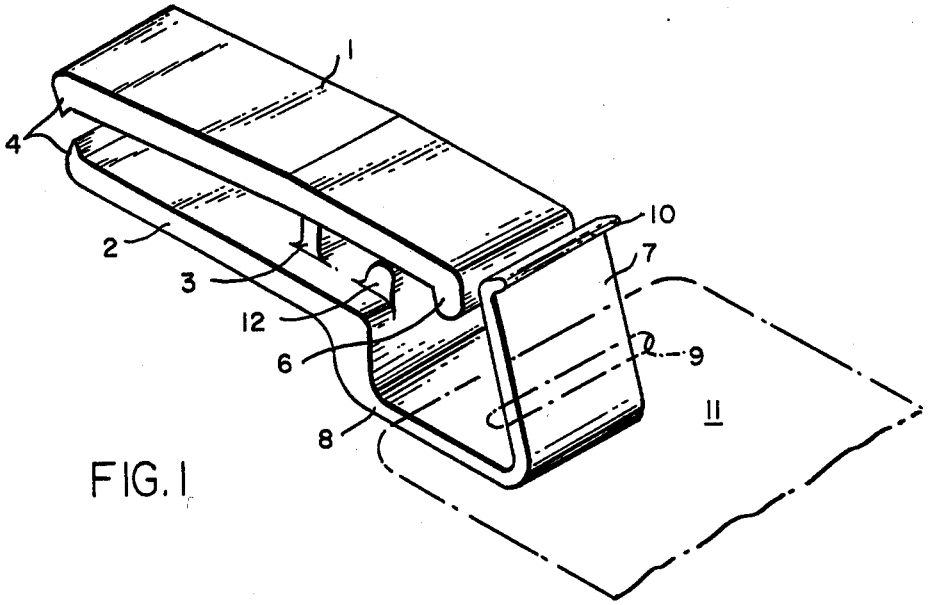
FIG. 1 is an isometric view of a clip member as formed, with a spring finger not yet bent to operative position.
Figure 2:
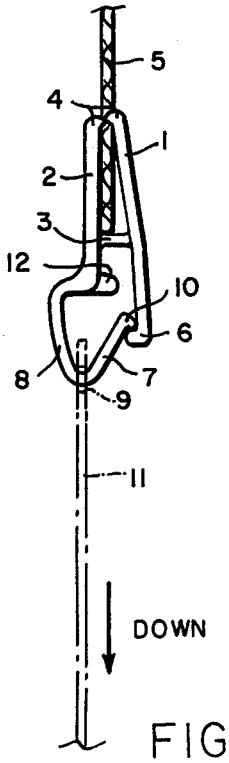
FIG. 2 is a side view with the jaws of the clip closed on a downwardly directed clothing hem.
Figure 3:
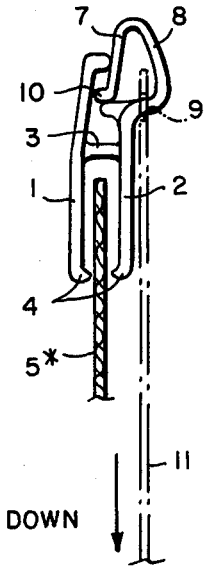
FIG. 3 is a side view with the clip jaws open to receive an upwardly directed hem.

Shown in FIGS. 1 to 3 is an ID card clip molded or extruded as a unitary body of plastic such as that known by the tradename DELRIN. The clip body comprises two generally parallel members 1 and 2 joined at their middle part by a web 3 forming a hinge between the members 1 and 2. By virtue of their greater cross section the hinged members are relatively rigid whereas the relatively thin hinge 3 is stiffly flexible. The ends of the hinged members 1 and 2 at one side of the hinge 3 form opposed jaws 4 for gripping the lapel or pocket hem of the wearer's clothing. At the other side of the hinge 3 one member 1 has an inwardly turned flange 6 while the other member 2 has a spring finger 7 having a portion 8 offset from the parallel hinged members 1 and 2. The spring finger 7 is adapted to be received in a slot or similar aperture 9 in an ID card or sheet 11. The spring finger 7 is then flexed with its outwardly extending flange 10 underneath the flange 6 of the other hinged member 1 so that it is resiliently biased against the other hinged member and urges the jaws closed on a hem 5 as shown in FIG. 2. To open the jaws the flanged end 6 and offset portion 8 of the members 1 and 2 are squeezed compressing the spring finger 7 until it abuts a stop 12 as shown in FIG. 3. The loop 7, 8 thus has the dual function of acting as a spring and as a holder receiving and engaging the ID card.

In FIG. 2 the clip is clamped on a downwardly hanging or directed hem of clothing such as a collar lapel or a pocket flap. The ID card can slide around the loop formed by the spring finger 7 so as to hang parallel and away from the hinged members 1 and so as to be flat on the wearer's clothing where it will not continuously interfere with arm movements. But if the wearer's clothing should not have a conveniently located downwardly hanging flap or hem the clip may be attached to an upwardly directed hem such as a pocket hem 5* as shown in FIG. 3. As shown therein the ID card 11 can slide around the spring finger 7 onto its offset portion 8 from which it can hang freely parallel to and alongside the hinged members 1 and 2 as well as flat on the wearer's clothing.

From the foregoing description it can be seen that the present ID card clip can be hung neatly from upwardly or downwardly directed clothing hems. The unitary body of the clip is far less expensive to manufacture than multipart metal clips and is lighter to wear and free from rust, while being available in a variety of colors.

It should be understood that the present disclosure is for the purpose of illustration only and that this invention includes all modifications and equivalents which fall within the scope of the appended claims.

I claim:

1. A spring clip comprising:

two elongate, relatively stiff members;

a relatively flexible web forming a hinge joining the two members intermediate their ends;

opposed jaw portions on respective members at one side of the hinge; and a spring finger on one member at the other side of the hinge resiliently biased into engagement against the other member so as yieldingly to hold the jaws closed, the spring finger forming an open loop disengageable from the other member for insertion through an aperture in an article, whereby the finger serves both as a spring to close the jaws and a holder for the article.

2. A clip according to claim 1 wherein the loop is offset from the members so that the sheet may hang parallel to the members.

3. A clip according to claim 1, in combination with a sheet having an aperture receiving the finger.

4. A clip according to claim 1 wherein said spring finger is intergral with and extends from one of said members reentrantly between said members into engagement inside the other member thereby to prevent the article from sliding off the spring finger.

5. A clip according to claim 4 wherein said spring finger slides along the other member when said spring finger is compressed to open the jaws, and said other member includes a stop limiting sliding of the finger and opening of the jaws.

* * * * *